US006745754B2

(12) United States Patent
Stenz et al.

(10) Patent No.: US 6,745,754 B2
(45) Date of Patent: Jun. 8, 2004

(54) ENGINE HAVING OIL FILL TUBE WITH INTEGRATED FUEL PUMP

(75) Inventors: Dennis N. Stenz, Mt. Calvary, WI (US); Allen A. Schmitz, Malone, WI (US); Kevin D. Steffes, Fond du Lac, WI (US); Scott J. Schneider, New Holstein, WI (US)

(73) Assignee: Tecumseh Products Company, Tecumseh, MI (US)

( * ) Notice: Subject to any disclaimer, the term of this patent is extended or adjusted under 35 U.S.C. 154(b) by 8 days.

(21) Appl. No.: 10/281,579

(22) Filed: Oct. 28, 2002

(65) Prior Publication Data

US 2004/0079343 A1 Apr. 29, 2004

(51) Int. Cl.[7] ..... F02M 33/04

(52) U.S. Cl. ..... 123/509; 123/DIG. 5; 417/395

(58) Field of Search ..... 123/509, 196 R, 123/196 A, 196 CP, 73 AF, 73 CC, 73 CB, DIG. 5; 417/395

(56) References Cited

U.S. PATENT DOCUMENTS

| | | | | |
|---|---|---|---|---|
| 1,613,312 | A | 1/1927 | Couts | |
| 3,556,687 | A | 1/1971 | O'Connor | 417/395 |
| 4,168,288 | A | 9/1979 | Nau et al. | 261/35 |
| 5,022,495 | A | 6/1991 | Lavender | 184/105.1 |
| 6,073,618 | A | 6/2000 | Sanders et al. | 123/572 |
| 6,279,522 | B1 | 8/2001 | Balzar et al. | 123/90.1 |
| 6,340,294 | B1 | 1/2002 | Kubota et al. | 417/395 |
| 6,363,905 | B1 | 4/2002 | Davis | 123/196 R |

FOREIGN PATENT DOCUMENTS

| | | |
|---|---|---|
| JP | 40-3217652 | 9/1991 |

*Primary Examiner*—Thomas N. Moulis
(74) *Attorney, Agent, or Firm*—Baker & Daniels

(57) ABSTRACT

An internal combustion engine having an engine housing containing an oil sump in communication with an oil fill conduit, and a fuel pump including a pump assembly having at least a portion thereof formed integrally with the oil fill conduit and in fluid communication therewith. The fuel pump is actuated by pressure pulses created within the engine crankcase when the engine is running, which are communicated to the fuel pump through the oil fill conduit.

21 Claims, 4 Drawing Sheets

ENGINE HAVING OIL FILL TUBE WITH INTEGRATED FUEL PUMP

BACKGROUND OF THE INVENTION

1. Field of the Invention

The present invention relates to small internal combustion engines of the type used with lawn mowers, lawn and garden tractors, snow throwers and other implements, or with small sport vehicles. Particularly, the present invention relates to small engines having a diaphragm-type fuel pump which is actuated by pressure pulses created within the engine crankcase when the engine is running.

2. Description of the Related Art

A typical internal combustion engine has an engine housing, including a crankcase containing an oil sump for receiving lubricating fluid or oil introduced through an oil fill conduit attached to the engine housing. The engine also includes a fuel supply system such as a fuel pump for pumping fuel from a fuel tank to a carburetor, where the fuel is mixed with air to form a fuel/air mixture for combustion. A common fuel pump includes a diaphragm which is reciprocated by pressure pulses generated within the crankcase during running of the engine, a fuel inlet for receiving the fuel from the fuel tank, and a fuel outlet for passing the fuel to the carburetor.

According to a known engine configuration shown in FIG. 1, an internal combustion engine 10 includes an engine housing 33 with crankcase 40, which contains oil sump 32 for receiving oil. Engine 10 further includes an oil fill tube 35 in communication with oil sump 32, wherein oil can be poured through oil fill tube 35 into oil sump 32. Engine 10 includes a diaphragm-type fuel pump 31 mounted to engine housing 33 with a fastener or a mounting bracket 14. Fuel pump 31 includes a pump assembly 36 having a fuel inlet 48 in communication with a fuel tank 46 by means of a fuel inlet line 49, and a fuel outlet 52 in communication with an air/fuel mixing device 44 such as a carburetor or a fuel injector, for example, by means of a fuel outlet line 53. Engine 10 further includes a pulse line 16 having a first end 26 and a second end 27. First end 26 of pulse line 16 is fastened with a first clamp 18 to a connection port 17 of crankcase 40, and second end 27 of pulse line 16 is connected to a pulse inlet 15 of pump assembly 36 by a second clamp 19, wherein pulse line 16 communicates pump assembly 36 with connection port 17 and crankcase 40.

In operation, when engine 10 starts to run, pressure pulses are created within crankcase 40 due to reciprocation of the piston (not shown) within the engine cylinder. The pulses are communicated from connection port 17 of crankcase 40 through pulse line 16 to actuate a diaphragm (not shown) within pump assembly 36, which reciprocates to draw fuel from fuel tank 46 through inlet line 49 into pump assembly 36, followed by driving the fuel from pump assembly 36 through fuel outlet line 53 to air/fuel mixing device 44.

Japanese Patent No. JP 403217652A discloses an engine including an engine housing containing a crankcase, an oil fill tube attached to the engine housing, and a fuel pump separately attached to the engine housing. The engine further includes a separate, dedicated pulse line connecting a pulse port of the oil fill tube to the fuel pump, such that crankcase pressure pulses are communicated to the fuel pump through the oil fill tube and the pulse line.

In each of the above configurations, a separate pulse line is required for communicating pressure pulses from the crankcase to the fuel pump. Further attachment components needed for the foregoing configurations include a bracket for fastening the fuel pump to the engine housing, a first clamp for fastening the pulse line to the fuel pump, and a second clamp for fastening an opposite end of the pulse line either to a connection port of the crankcase or to a pulse port of the oil fill tube.

It is desirable to simplify the forgoing fuel pump configuration in order to reduce the total number of parts used, as well as the labor required for assembling same.

SUMMARY OF THE INVENTION

The present invention provides an internal combustion engine with an engine housing containing an oil sump in fluid communication with an oil fill conduit, and a fuel pump including a pump assembly having at least a portion thereof formed integrally with the oil fill conduit and in fluid communication therewith. The fuel pump is actuated by pressure pulses created within the engine crankcase when the engine is running, which are communicated to the fuel pump through the oil fill conduit.

The engine may have a shroud attached to the crankcase and covering at least a portion thereof. Optionally, a bracket may be integrally formed with the oil fill conduit which, along with a fastener, is used to attach to the oil fill conduit to the shroud of the engine or other suitable engine structure.

The fuel pump includes a pump assembly having a pump housing and a diaphragm therewithin, which is actuated by pressure pulses generated within the engine crankcase during running of the engine. The portion of the fuel pump which is integrally formed with the oil fill conduit further includes a pulse passage to communicate the fuel pump with the interior space of the oil fill conduit. The pulse passage extends upwardly from an interior wall of the oil fill conduit to prevent oil from entering the pulse passage when oil is filled through the oil fill conduit into the oil sump.

The fuel pump housing further includes a fuel inlet in fluid communication with a fuel tank, and a fuel outlet in fluid communication with an air/fuel mixing device. The fuel pump is operable to pump fuel from the fuel tank to the air/fuel mixing device. Specifically, the engine may include a fuel inlet line communicating the fuel tank with the fuel inlet, and a fuel outlet line communicating the fuel outlet with the air/fuel mixing device.

Advantageously, the present invention, in integrating at least a portion of the fuel pump with the oil fill conduit, obviates need for a pulse port on the crankcase and a separate pulse line, as well as a plurality of clamps used to fasten the pulse line to the crankcase and to the fuel pump, thereby reducing the number of parts used in the fuel supply system of the engine and the manufacturing steps needed to assemble the engine.

In one form thereof, the present invention provides an internal combustion engine, including an engine housing containing an oil sump therein; an oil fill conduit in fluid communication with the oil sump; and a fuel pump including a pump assembly, at least a portion of the pump assembly integrally formed with the oil fill conduit and in fluid communication therewith.

In another form thereof, the present invention provides an internal combustion engine, including a crankcase containing an oil sump therein; an oil fill tube attached to the crankcase in fluid communication with the oil sump; a fuel pump including a pump assembly, at least a portion of the pump assembly integrally formed with the oil fill tube and in fluid communication therewith; and a diaphragm disposed within the pump assembly, the diaphragm actuated by pressure pulses generated within the crankcase during running of the engine, the pressure pulses communicated to the pump assembly from the crankcase through the oil fill tube.

In a further form thereof, the present invention provides an internal combustion engine, including a crankcase containing an oil sump therein; at least one cylinder connected to the crankcase; a crankshaft rotatably carried within the crankcase; a least one connecting rod and piston assembly coupled to the crankshaft, the at least one piston reciprocable within a respective the cylinder to generate pressure pulses within the crankcase; an oil fill tube attached to the crankcase in fluid communication with the oil sump; and a fuel supply system for the engine, including a fuel tank; a carburetor; a fuel line connecting the fuel tank with the carburetor; and a fuel pump in disposed within the fuel line, the fuel pump including a pump assembly having a diaphragm therein, at least a portion of the pump assembly integrally formed with the oil fill tube and in fluid communication therewith, wherein the diaphragm is actuated by the pressure pulses to pump fuel from the fuel tank to the carburetor.

In a still further form thereof, the present invention provides a fuel pump and oil fill tube assembly, including an oil fill tube; and a fuel pump, at least a portion of the fuel pump integrally formed with the oil fill tube and in fluid communication therewith.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 1:
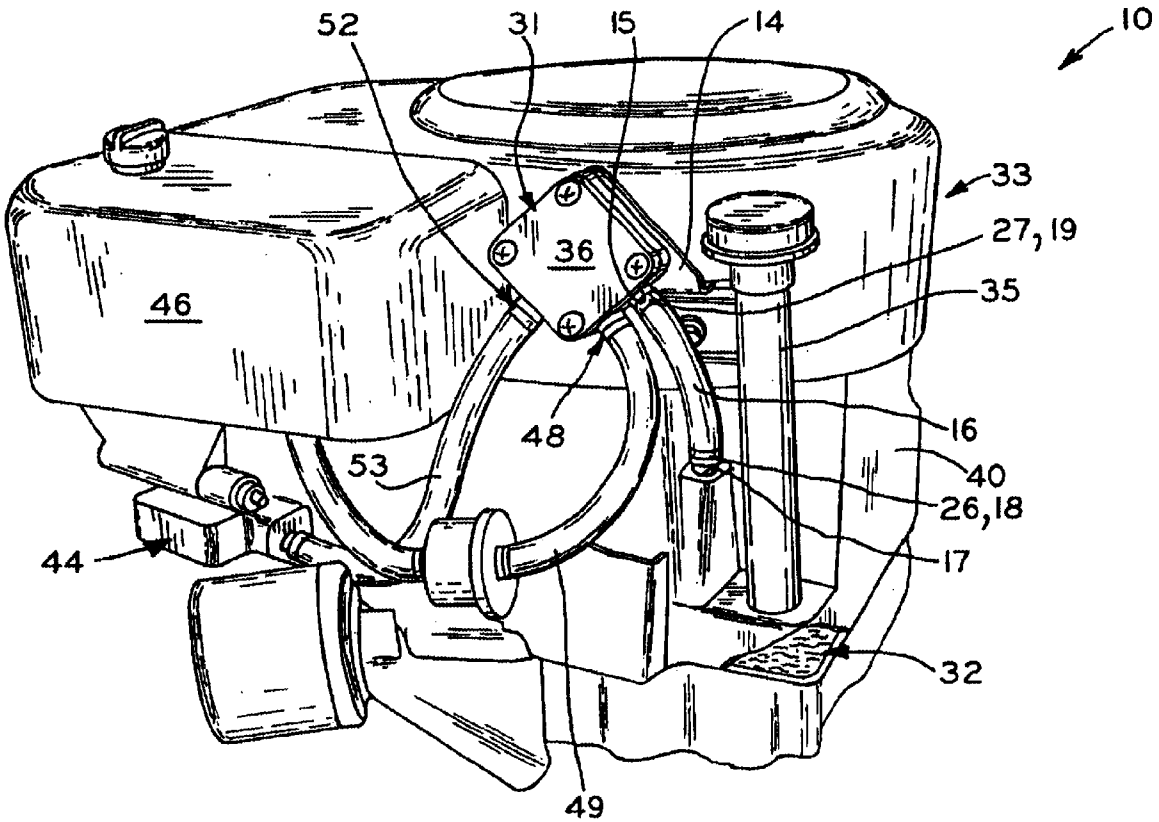
FIG 1 PRIOR ART
FIG. 1 is a perspective, partially cut away view of a known configuration of an internal combustion engine, showing a fuel pump attached to the engine housing, the fuel pump in communication with the engine crankcase through a separate pulse line.
Figure 2:
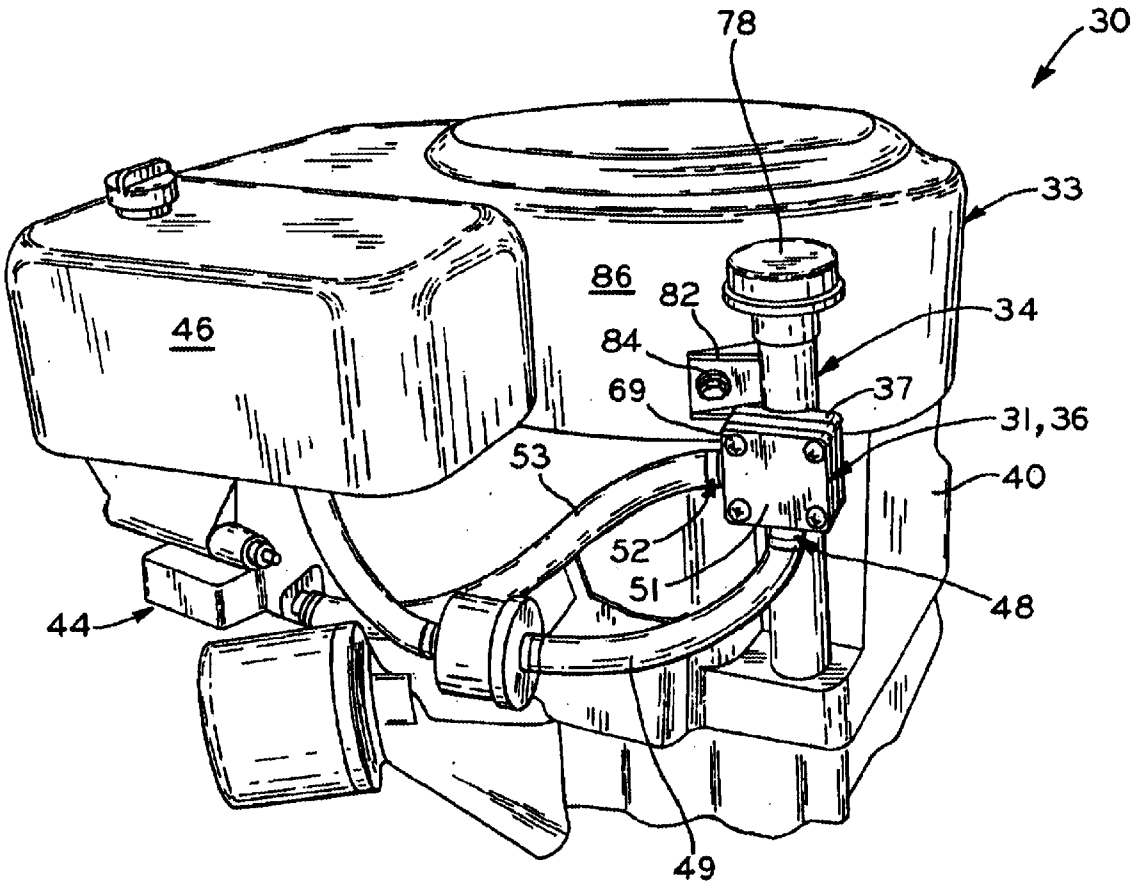
FIG. 2 is a perspective, partially cut away view of one embodiment of the internal combustion engine of the present invention, showing the fuel pump having at least a portion thereof integrally formed with an oil fill conduit.
Figures 3, 4:
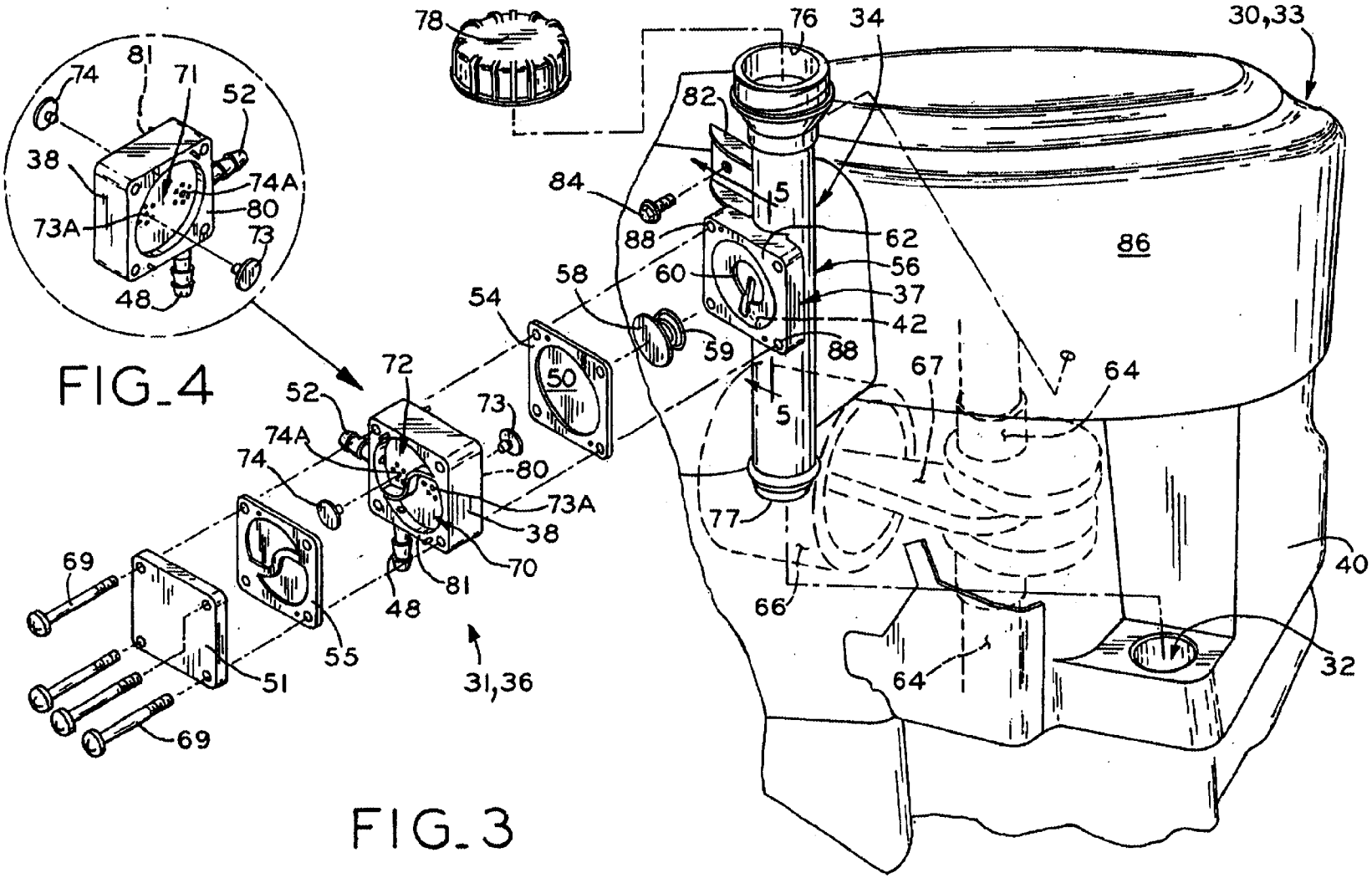
FIG. 3 is an exploded view of the oil fill conduit and fuel pump assembly of the engine of FIG. 2.
FIG. 4 is a perspective view of a rear side of a fuel pump housing component of the fuel pump assembly of FIG. 3.
Figure 6:
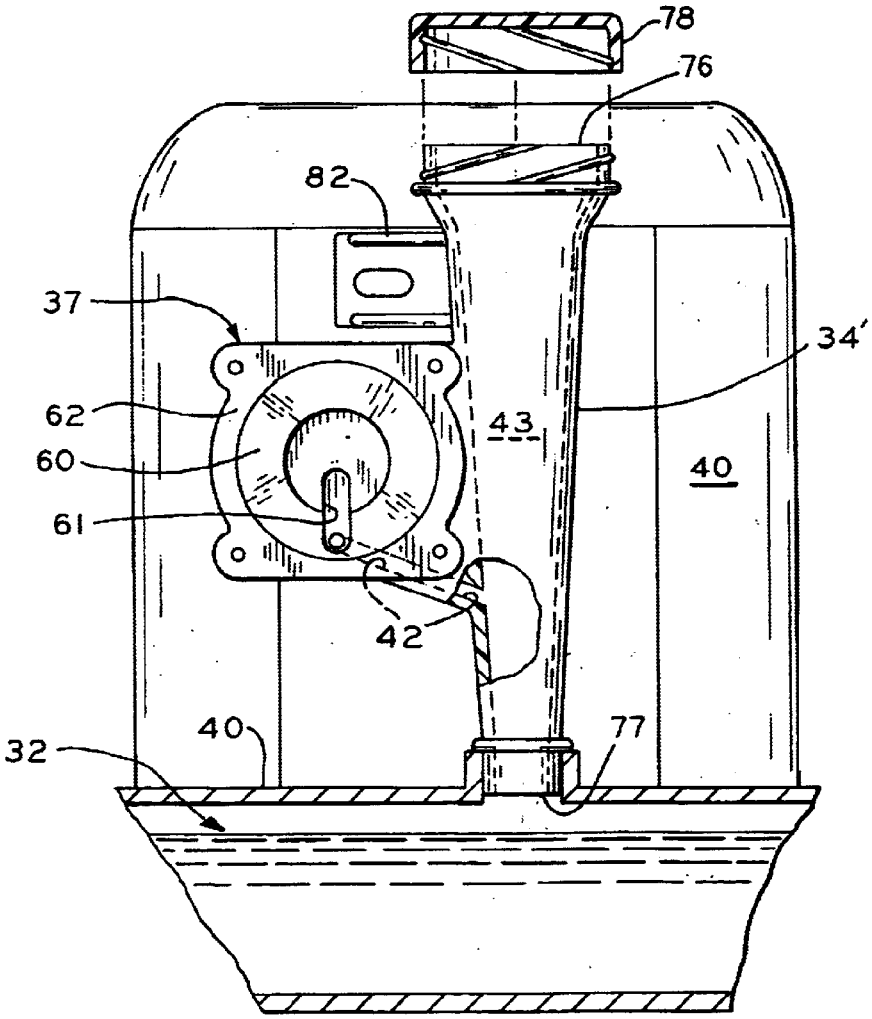
FIG. 6 is a front, partially cut away view of an oil fill conduit and fuel pump assembly according to another embodiment of the present invention.

Referring to FIGS. 2 and 3, engine 30 includes an engine housing 33 with a crankcase 40 containing an oil sump 32 therein (FIG. 6). Oil fill conduit 34 is connected to crankcase 40 in communication with oil sump 32. Oil fill conduit 34 may include similar features as the oil fill tube disclosed in U.S. Pat. No. 6,363,905, assigned to the assignee of the present invention, the disclosure of which is expressly incorporated herein by reference. However, as described in more detail below, unlike engine 10 shown in FIG. 1 which includes a separate fuel pump 31 attached to engine housing 33 and also attached to crankcase 40 via a separate pulse line 16, engine 30 shown in FIG. 2 includes fuel pump 31 having at least a portion thereof which is integrally formed with oil fill conduit 34 and in communication therewith.

Referring to FIGS. 2 and 3, oil fill conduit 34, shown herein as an oil fill tube, is attached to and in communication with crankcase 40. Oil fill conduit 34 has a top opening 76 for receiving oil, and a bottom opening 77 attached to crankcase 40 in communication with oil sump 32 via a press-fit or screw-threaded engagement, for example. Oil may be introduced through top opening 76 of oil fill conduit 34 to fill oil sump 32. Oil fill conduit 34 includes cap 78, which can be secured on oil fill conduit 34 for closing top opening 76 via a screw-thread engagement, for example.

As shown in FIGS. 2 and 3, oil fill conduit 34 has a cylindrical shape with a substantially uniform cross-section from top opening 76 to bottom opening 77. Alternatively, as shown in FIG. 6, oil fill conduit 34' may have a somewhat conical shape, for example, with a larger cross-section at its top end than at its bottom end. Accordingly, the overall shape of oil fill conduit may vary.

As shown in FIGS. 2–3, oil fill conduit 34 includes a bracket 82 integrally formed therewith, and at least one fastener 84 is used for connecting bracket 82 to shroud 86 or any other suitable portion of engine housing 33.

Figure 5:
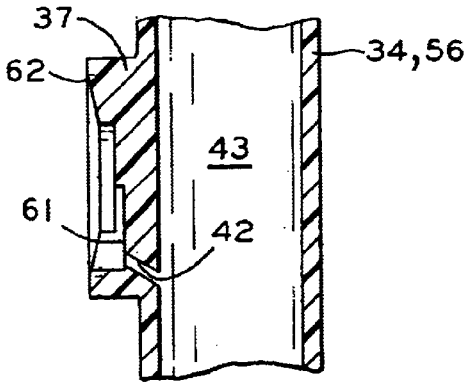
FIG. 5 is a sectional view of the oil fill conduit and fuel pump assembly of FIG. 3, taken along line 5—5 of FIG. 3.

Referring to FIGS. 3 and 5, fuel pump 31 includes a pump assembly 36 including a pump base 37 integrally formed with a central portion 56 of oil fill tube 35. Pump assembly 36 further includes a pump housing 38 having a fuel inlet 48 and a fuel outlet 52, and a pump cover 5 1. Referring to FIGS. 3, 5, and 6, pump base 37 defines a pulse passage 42 therein in communication with an inner space 43 of oil fill conduit 34. Pulse passage 42 opens to a recess 60 defined on a front surface 62 of pump base 37. Oil fill conduit 34 and a portion of pump assembly 36, such as pump base 37, for example, may be integrally formed of any suitable material such as metal, or a molded plastic or other synthetic resin.

In one embodiment of the invention, as shown in FIGS. 2, 3, and 5, pump base 37 is centrally formed with respect to oil fill conduit 34, such that pump base 37 is disposed on the front side of oil fill conduit 34. Pulse passage 42 communicates between pump base 37 and oil fill conduit 34, and extends upwardly from an interior wall of oil fill conduit 34 to front side 62 of pump base 37 to thereby prevent oil from entering pulse passage 42 when oil is filled through oil fill conduit 34 into oil sump 32.

In an alternative embodiment, shown in FIG. 6, pump base 37 is integrally formed with oil fill conduit 34 such that pump base 37 is disposed at one side of oil fill conduit 34. Pulse passage 42 communicates between pump base 37 and oil fill conduit 34, and extends upwardly from the interior wall of oil fill conduit 34 to channel 61 of pump base 37 to prevent oil from entering pulse passage 42 when oil is filled through oil fill conduit 34 into oil sump 32.

Referring to FIG. 3, fuel pump assembly 36 further includes a first gasket 54 defining a diaphragm 50 disposed centrally of first gasket 54. First gasket 54 is captured between pump base 37 and pump housing 38, and serves to seal pump housing 38 to pump base 37 when pump assembly 36 is assembled. Diaphragm 50 is capable of reciprocating when actuated by pressure pulses. First gasket 54 and diaphragm 50 may be made of a single piece of flexible material such as rubber or other suitable elastomeric materials.

Pump assembly 36 includes pestle 58 fitted with a spring 59 seated in recess 60 of pump base 37. Pestle 58 is in supporting contact with diaphragm 50, wherein when diaphragm 50 flexes towed pump base 37, pestle 58 moves with diaphragm 50 against the bias of spring 59 toward pump base 37, and when diaphragm 50 flexes away from pump base 37, spring 59 expands and pushes pestle 58 against diaphragm 50.

As shown in FIGS. 3 and 4, pump housing 38 is disposed between pump base 37 and pump cover 51. Pump housing 38 defines a first side 80 facing pump base 37, and a second side 81 facing pump cover 51. First side 80 defines a flow chamber 71, and second side 81 defines an inlet chamber 70 and an outlet chamber 72. Inlet chamber 70 is in communication with fuel inlet 48, and outlet chamber 72 is in communication with fuel outlet 52. Flow chamber 71 has a first check valve 73 and a plurality of inlet openings 73A communicating with inlet chamber 70. Outlet chamber 72 has a second check valve 74 and a plurality of outlet openings 74A communicating with flow chamber 71. First check valve 73 operates to permit fuel flow from inlet chamber 70 through plurality of inlet openings 73A into flow chamber 71, while preventing fuel flow from flow chamber 71 back into inlet chamber 70. Second check valve 74 operates to permit fuel flow from flow chamber 71 through plurality of outlet openings 74A into outlet chamber 72, while preventing fuel flow from outlet chamber 72 back into flow chamber 71.

Pump assembly 36 includes second gasket 55 captured between pump housing 38 and pump cover 51. Second gasket 55 serves to seal inlet chamber 70 and outlet chamber 72 when pump assembly 36 is assembled. Second gasket 55 can be made of any suitable flexible material such as rubber or another elastomeric material. Cover 51 is stacked against second gasket 54. The components of pump assembly 36 can be tightly secured together using fasteners, such as screws 69, which pass through aligned apertures in cover 51, second gasket 55, pump housing 38, first gasket 54, and into threaded holes 88 in pump base 37.

Returning to FIG. 2, engine 30 further includes a fuel inlet line 49 and a fuel outlet line 53. Fuel inlet line 49 has one end attached to a fuel tank 46, and an opposite end attached to fuel inlet 48 of pump housing 38 to communicate fuel tank 46 with fuel inlet 48. Fuel outlet line 53 has one end attached to fuel outlet 52 of pump housing 38 and an opposite end attached to an air/fuel mixing device 44 to communicate fuel outlet 52 with air/fuel mixing device 44. Air/fuel mixing device 44 may be a carburetor, which provides an air/fuel combustion mixture to engine 30, or alternatively, may be a fuel injection mechanism.

In one specific embodiment, as shown in FIG. 3, internal combustion engine 30 includes a crankcase 40 containing an oil sump 32 therein, and at least one cylinder (not shown) connected to crankcase 40. A crankshaft 64 is rotatably carried within crankcase 40, and is coupled to piston 66 by connecting rod 67. Piston 66 reciprocates within the cylinder to generate pressure pulses within crankcase 40 during running of engine 30.

With reference to FIGS. 2–3, the operation of internal combustion engine 30 will now be explained. Crankshaft 64 and piston 66 may be manually cranked by an operator for engine starting using a recoil pull-type starter (not shown), or may be non-manually cranked by a starter motor, for example. After starting, and during running of engine 30, reciprocation of piston 66 within the cylinder creates pressure fluctuations, or pulses, within crankcase 40. Specifically, as piston 66 approaches its top dead center "TDC"position, a negative, or less than atmospheric, pressure is created within crankcase 40 and, as piston 66 retreats from its TDC position toward its bottom dead center position, a positive, or greater than atmospheric, pressure is created within crankcase 40.

The pressure pulses in crankcase 40 enter oil fill conduit 34 through bottom opening 77 of oil fill conduit 34, and are communicated through pulse passage 42 to pump base 37. The pressure pulses reciprocate diaphragm 50 of pump assembly 36, causing fuel pump 31 to draw the fuel through inlet 48 into pump 31 and subsequently drive the fuel through fuel outlet 52.

Specifically, a negative pressure pulse causes diaphragm 50 to flex toward pump base 37, pushing pestle 58 against the bias of spring 59, causing spring 59 to contract. At the same time, first check valve 73 opens to allow the fuel to flow from inlet chamber 70 into flow chamber 71 through inlet openings 73A, while second check valve 74 closes outlet openings 74A, blocking the fuel from flowing into outlet chamber 72. During flow of the fuel from inlet chamber 70 into flow chamber 71, the fuel is drawn from fuel tank 46 through fuel inlet 48 into inlet chamber 70.

A positive pulse causes diaphragm 50 to flex away from pump base 37, and spring 59 expands to push pestle 58 in supporting contact with diaphragm 50 away from pump base 37. This movement of diaphragm 50 causes second check valve 74 to open, allowing the fuel to flow from flow chamber 71 into outlet chamber 72 through outlet openings 74A and through fuel outlet 52 to air/fuel mixing device 44 through line 53. At the same time, first check valve 73 closes inlet openings 73A to prevent the fuel from flowing from inlet chamber 70 back to flow chamber 71.

The positive and negative pulses occur rapidly within crankcase 40, fluctuating diaphragm 50 very rapidly to pump fuel from fuel tank 46 to air/fuel mixing device 44, keeping engine 30 running.

According to the embodiments of the present invention described hereinabove, the pressure pulses are communicated from crankcase 40 to fuel pump 31 through oil fill conduit 34, without requiring additional components such as a separate pulse line 16 and clamps for connecting same, as shown in the known engine of FIG. 1. However, other configurations not requiring a separate pulse line 16 may also be contemplated in view of the teachings herein. For example, the engine may include a fuel pump having a portion thereof integrally formed with the crankcase, and communicating with an oil fill conduit which is in the form of a bore formed in the crankcase through which oil may be filled. Alternatively, the fuel pump may have a diaphragm exposed to the inside of the crankcase, wherein pressure pulses created in the crankcase directly actuate the diaphragm to operate the fuel pump.

The engine of the present invention has many advantages. For example, since the fuel pump is integrally formed with the oil fill conduit, there is no need for a separate attachment of the fuel pump to the engine housing, using a separate bracket and fasteners, for example. In addition, the need of a separate pulse line and related attachment components such as clamps are not needed. Further, the fuel pump and oil fill conduit assembly of the present invention may be manufactured and sold as a unit, making it convenient to install onto an engine. In this manner, the difficulty of assembling of the engine is reduced, leading to a reduction in labor requirements and related costs.

While the present invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An internal combustion engine, comprising:

an engine housing containing an oil sump therein;

an oil fill conduit in fluid communication with said oil sump; and a fuel pump including a pump assembly, at least a portion of said pump assembly integrally formed with said oil fill conduit and in fluid communication therewith.

2. The internal combustion engine of claim 1, wherein said engine housing comprises a crankcase, and said oil fill conduit comprises an oil fill tube attached to said crankcase.

3. The internal combustion engine of claim 1, wherein said pump assembly includes a diaphragm actuated by pressure pulses generated within said engine housing during running of said engine, said pressure pulses communicated to said pump assembly from said engine housing through said oil fill conduit.

4. The internal combustion engine of claim 1, further comprising a fuel tank and an air/fuel mixing device.

5. The internal combustion engine of claim 4, wherein said pump assembly further comprises:

a fuel inlet in fluid communication with said fuel tank; and a fuel outlet in fluid communication with said air/fuel mixing device, wherein said fuel pump is operable to pump fuel from said fuel tank to said air/fuel mixing device.

6. The internal combustion engine of claim 5, further comprising:

a fuel inlet line fluidly communicating said fuel tank with said fuel inlet; and a fuel outlet line fluidly communicating said fuel outlet with said air/fuel mixing device.

7. The internal combustion engine of claim 2, further comprising:

a shroud attached to said crankcase and covering at least a portion thereof;

a bracket integrally formed with said oil fill tube; and at least one fastener connecting said bracket to said shroud to secure said oil fill tube to said engine.

8. The internal combustion engine of claim 1, wherein said pump assembly includes a pulse passage communicating said pump assembly with said oil fill conduit, said pulse passage extending upwardly from an interior wall of said oil fill conduit to prevent oil from entering said pulse passage when oil is filled through said oil fill conduit into said oil sump.

9. The internal combustion engine of claim 1, wherein said fuel pump is centrally positioned with respect to said oil fill conduit.

10. The internal combustion engine of claim 1, wherein said fuel pump is positioned at a side of said oil fill conduit.

11. An internal combustion engine, comprising:

a crankcase containing an oil sump therein;

an oil fill tube attached to said crankcase in fluid communication with said oil sump;

a fuel pump including a pump assembly, at least a portion of said pump assembly integrally formed with said oil fill tube and in fluid communication therewith; and a diaphragm disposed within said pump assembly, said diaphragm actuated by pressure pulses generated within said crankcase during running of said engine, said pressure pulses communicated to said pump assembly from said crankcase through said oil fill tube.

12. The internal combustion engine of claim 11, further comprising:

a fuel tank; and an air/fuel mixing device, said pump assembly further including a fuel inlet in fluid communication with said fuel tank, and a fuel outlet in fluid communication with said air/fuel mixing device, wherein said fuel pump is operable to pump fuel from said fuel tank to said air/fuel mixing device.

13. The internal combustion engine of claim 11, further comprising:

a shroud attached to said crankcase and covering at least a portion thereof;

a bracket integrally formed with said oil fill tube; and at least one fastener connecting said bracket to said shroud to secure said oil fill tube to said engine.

14. The internal combustion engine of claim 11, wherein said pump assembly includes a pulse passage communicating said pump assembly with said oil fill tube, said pulse passage extending upwardly from an interior wall of said oil fill tube to prevent oil from entering said pulse passage when oil is filled through said oil fill tube into said oil sump.

15. An internal combustion engine, comprising:

a crankcase containing an oil sump therein;

at least one cylinder connected to said crankcase;

a crankshaft rotatably carried within said crankcase;

a least one connecting rod and piston assembly coupled to said crankshaft, said at least one piston reciprocable within a respective said cylinder to generate pressure pulses within said crankcase;

an oil fill tube attached to said crankcase in communication with said oil sump; and a fuel supply system for said engine, comprising:

a fuel tank;

a carburetor;

a fuel line connecting said fuel tank with said carburetor; and a fuel pump in disposed within said fuel line, said fuel pump including a pump assembly having a diaphragm therein, at least a portion of said pump assembly integrally formed with said oil fill tube and in fluid communication therewith, wherein said diaphragm is actuated by said pressure pulses to pump fuel from said fuel tank to said carburetor.

16. The internal combustion engine of claim 15, further comprising:

a shroud attached to said crankcase and covering at least a portion thereof;

a bracket integrally formed with said oil fill tube; and at least one fastener connecting said bracket to said shroud to secure said oil fill tube to said engine.

17. A fuel pump and oil fill tube assembly, comprising:

an oil fill tube; and a fuel pump, at least a portion of said fuel pump integrally formed with said oil fill tube and in fluid communication therewith.

18. The fuel pump and oil fill tube assembly of claim 17, wherein said fuel pump comprises:

a pulse passage fluidly communicating said fuel pump with said oil fill tube, said pulse passage extending upwardly from an interior wall of said oil fill tube to prevent oil from entering said pulse passage when oil is filled through said oil fill tube;

a fuel inlet and a fuel outlet; and a diaphragm reciprocable by pressure pulses communicated to said fuel pump through said pulse passage, whereby the reciprocation of said diaphragm causes the fuel to enter said fuel pump through said fuel inlet and leave said fuel pump through said fuel outlet.

19. The fuel pump and oil fill tube assembly of claim 17, wherein said fuel pump is positioned centrally with respect to said oil fill tube.

20. The fuel pump and oil fill tube assembly of claim 17, wherein said fuel pump is positioned at one side of said oil fill tube.

21. The fuel pump and oil fill tube assembly of claim 17 further comprising:

a bracket integrally formed with said oil fill tube; and at least one fastener for connecting said bracket to an engine.

* * * * *